US005297814A

United States Patent [19]

Peters

[11] Patent Number: 5,297,814

[45] Date of Patent: Mar. 29, 1994

[54] CLIPBOARD FOR TEACHING CHILDREN TO WRITE CORRECTLY

[76] Inventor: Eddie R. Peters, 6207 Davidson Dr., Sand Springs, Okla. 74063

[21] Appl. No.: 979,587

[22] Filed: Nov. 20, 1992

[51] Int. Cl.[5] ..... B42F 9/00; B42D 15/00

[52] U.S. Cl. ..... 281/45; 283/45

[58] Field of Search ..... 281/45, 51; 283/45, 283/117

[56] References Cited

U.S. PATENT DOCUMENTS

| | | | |
|---|---|---|---|
| D. 298,955 | 12/1988 | Zovar . | |
| D. 313,819 | 1/1991 | Craft, Jr. et al. . | |
| 625,563 | 6/1900 | Magee | 283/45 |
| 672,087 | 4/1901 | Williams et al. | 283/45 X |
| 1,347,729 | 7/1920 | Wride | 283/45 X |
| 3,670,370 | 6/1972 | Goodwin . | |
| 4,645,163 | 2/1987 | Zovar . | |
| 4,955,576 | 9/1990 | Moberg . | |
| 5,226,215 | 7/1993 | Evenson | 281/45 X |

FOREIGN PATENT DOCUMENTS

| | | | |
|---|---|---|---|
| 35674 | 10/1913 | Sweden | 283/45 |
| 2204830 | 11/1988 | United Kingdom | 281/45 |

OTHER PUBLICATIONS

IBM Technical Disclosure Bulletin; vol. 13, No. 11;

*Guidelines for Handprinting;* Hamburgen, A.; Apr.-71 p. 3518.

*Italic Instruction Copy Book;* Pentalic Corp; New York; Circa 1990.

Eaton Corp, Calligrapy Writing Paper Tablet; Circa 1990.

*Primary Examiner*—Paul A. Bell

*Attorney, Agent, or Firm*—Catalano, Zingerman & McKay

[57] ABSTRACT

The present invention is a clipboard which attaches by means of a lip provided on a lower edge of the clipboard to a front edge of a typical school desktop so that the clipboard lies flat against the desktop. The clipboard is provided with an upper area which is tilted either left or right with respect to the front edge of the desktop, the angle of the tilt being that required for proper paper placement for writing and the direction of the tilt being dependent upon whether the clipboard is designed for a right-handed or left-handed student. The upper area is provided with horizontal writing lines and is preferably made of an erasable material so the student can mark directly on it. A clip is provided for securing paper to the clipboard. A number line and an alphabet are also provided on the clipboard, with each numeral and each letter being provided with a dot and one or more arrows to indicate proper initial placement and proper movement of a writing instrument to correctly make the numeral or letter.

20 Claims, 3 Drawing Sheets

CLIPBOARD FOR TEACHING CHILDREN TO WRITE CORRECTLY

BACKGROUND OF THE INVENTION

1. Field of the Invention

The present invention relates to a device for teaching children how to write correctly. Specifically, the present invention is an erasable board which attaches to child's desk and lies flat on the desktop. The board is provided with a means for securing paper thereto and is angled relative to the desk to position the paper properly for writing.

2. Description of the Related Art

Proper placement of writing paper is important for good writing skills because improper placement can contribute to poor penmanship and can cause writer's fatigue; commonly referred to as "writer's cramp". To be properly placed for writing, the paper should be in front of a child or student with the top of the paper angled slightly away from the student's hand which is holding the writing instrument. Thus, for a right-handed student, the top of the paper should tilt to the left, and for a left-handed student, the top of the paper should tilt to the right.

Many young students do not know how to properly place their paper on their desk in order to write comfortably and efficiently. Often teachers do not take the time to tell students about proper paper placement or to see that students continue to use proper placement as they learn to write. As a result, students can find writing inefficient, uncomfortable and generally unpleasant.

The present invention addresses this problem by providing a means to assist in teaching children proper paper placement and correct writing techniques. Specifically, the present invention is an erasable board which lays on top of and secures to a student's desk. The board is provided with a clip for securing paper to the board and is angled to insure proper paper placement for writing.

SUMMARY OF THE INVENTION

Briefly, the invention is a clipboard which secures to a front edge of a desktop by means of a lip provided on the clipboard's lower edge and designed to hold paper at the proper angle for writing. The clipboard lies flat against the desktop and is provided with a lower trapezoidal shaped area adjacent to the clipboard's lower edge and an upper trapezoidal shaped area whose sides and top are slanted in relationship to the desktop's front edge. At least the upper area is preferably made of erasable material and is slanted by virtue of it being attached to the lower area to form an obtuse angle either between left sides of the upper and lower areas or between right sides of the upper and lower areas. An upper edge of the upper area is provided with a number line, and the left side of the upper area is provided with an alphabet. Each numeral in the number line and each letter in the alphabet is provided with a dot to indicate proper initial placement of a writing instrument and is provided with at least one arrow to indicate proper movement of the writing instrument for correctly making the numeral or letter. Repeating sets of three evenly spaced parallel lines are provided on the upper area between the left and right upper area sides, with a top line of each set being a solid green line, a middle line of each set being a broken yellow line, and a bottom line of each set being a solid red line. The clipboard is provided with a clip near the upper edge for securing paper to the upper area.

DETAILED DESCRIPTION OF THE PREFERRED EMBODIMENT

Figure 1:
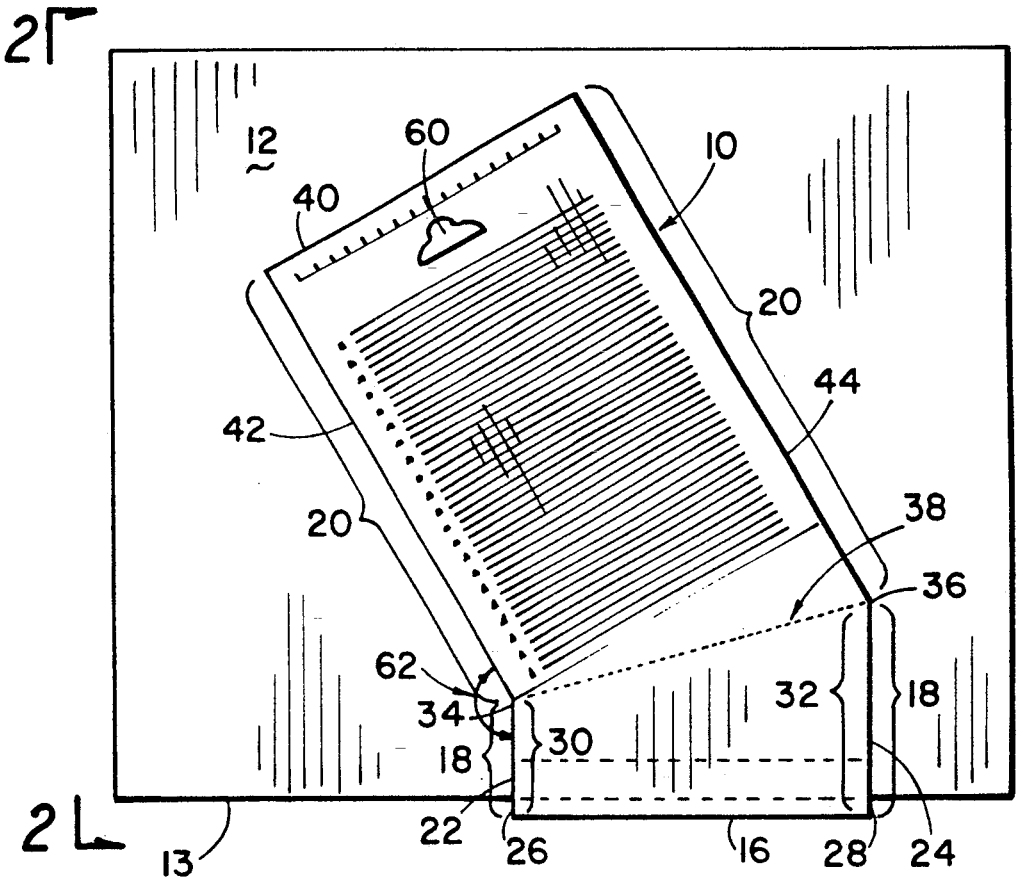
FIG. 1 is a top plan view of a desktop to which is secured a clipboard constructed according to a preferred embodiment of the present invention.
Figure 2:
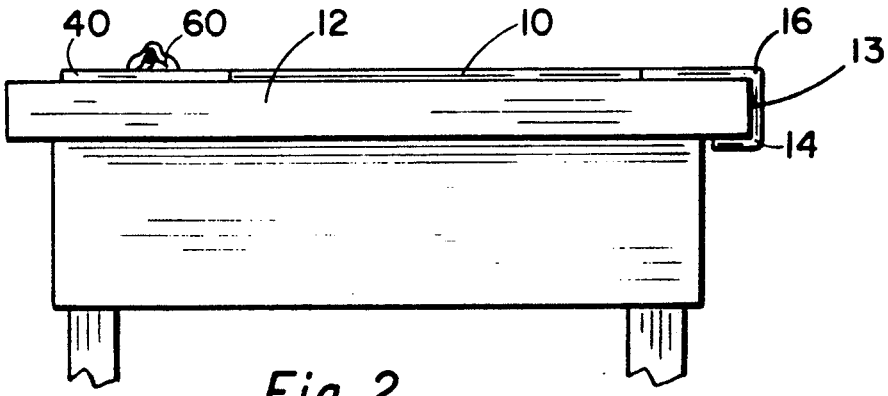
FIG. 2 is a left side elevation taken along line 2—2 of FIG. 1.

Referring now to the drawings and initially to FIGS. 1 and 2, there is illustrated a clipboard constructed according to a preferred embodiment of the present invention. The clipboard 10 is planer so that it lies flat on a desktop 12. The clipboard 10 is secured to a front edge of 13 the desktop 12 by means of a lip 14 provided on a lower edge 16 of the clipboard 10. Optionally Or in addition to the lip 14, VELCRO ® (not shown) may be placed on the lip 14 and on the desktop 12 to hold the clipboard 10 on the desktop 12 or, alternately, other suitable means of attachment may be used for this purpose.

The clipboard 10 is comprised of two areas, a lower trapezoidal shaped area 18 and an upper trapezoidal shaped area 20. The lower trapezoidal shaped area 18 has parallel left and right lower area sides 22 and 24 connecting perpendicularly by their lower ends 26 and 28 respectively to the lower edge 16 so that the lower edge 16 forms a third side of the lower trapezoidal shaped area 18. The left and right lower area sides 22 and 24 are of unequal lengths, 30 and 32 respectively. A left-handed clipboard (not illustrated) designed for use by a left-handed student (not shown) has the length 30 exceeding the length 32. Conversely, a right-handed clipboard 10, such as illustrated in FIG. 1, designed for use by a right-handed student (not shown) has the length 32 exceeding the length 30. The left and right lower area sides 22 and 24 connect by their upper ends 34 and 36 respectively to a bottom side 38 of the upper area 20 so that the bottom side 38 of the upper area 20 forms a fourth side of the lower trapezoidal shaped area 20.

The upper trapezoidal shaped area 20 is defined by the bottom side 38 of the upper area 20, an opposite upper edge 40, a left upper area side 42 and an opposite right upper area side 44. The left upper area side 42 is parallel to the right upper area side 44 and both sides 42 and 44 are perpendicular to the upper edge 40.

Figure 3:
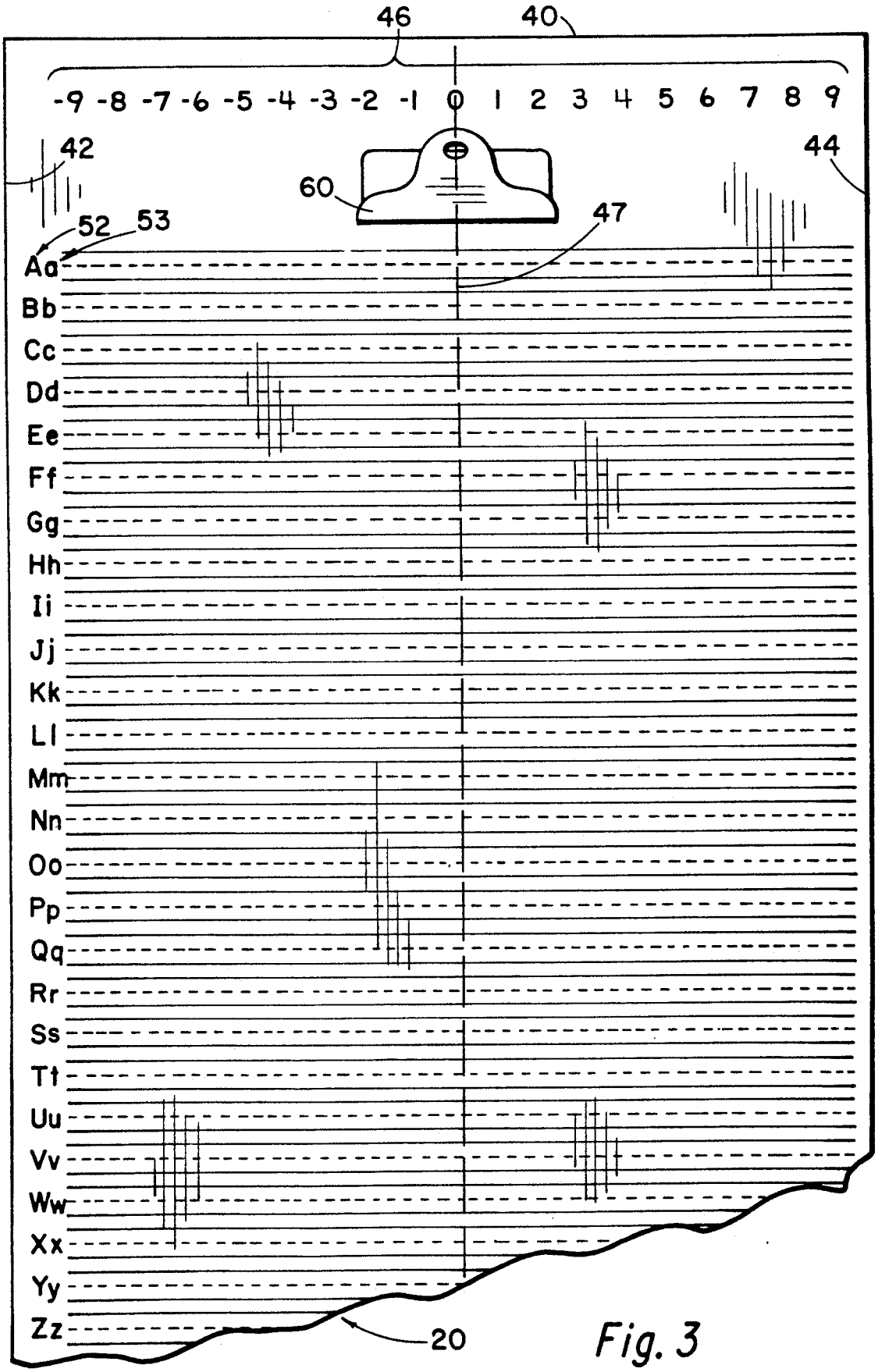
FIG. 3 is an enlarged partial view of the trapezoidal shaped upper area of the clipboard.

Referring now to FIG. 3, the upper area 20 is shown in more detail. A number line 46 is provided along the upper edge 40. The number line 46 has a numeral "0" located along a middle line 47 halfway between the left and right upper area sides 42 and 44 of the upper area 2o. Moving horizontally from the numeral "0" toward the left upper area side 42, negative numbers of increasing absolute value are consecutively listed, ending with numeral "−9". Likewise, in moving horizontally from the numeral "0" toward the right upper area side 44, increasing values of positive numbers are consecutively listed, ending with the numeral "+9".

Figure 4:
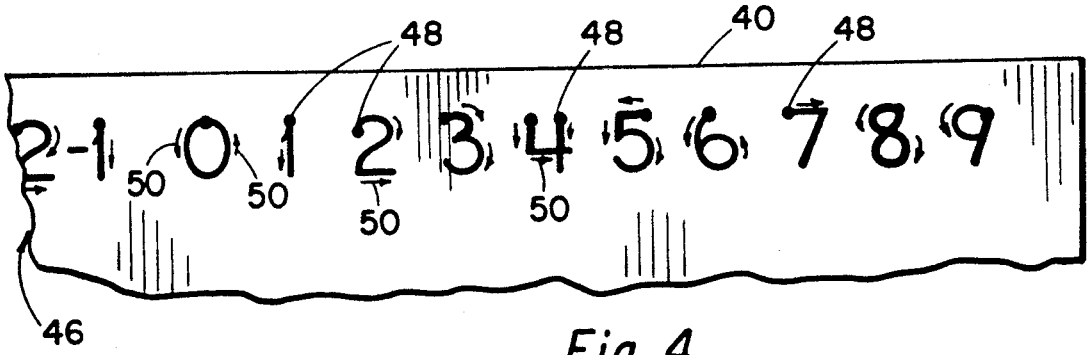
FIG. 4 is an enlarged partial view of the number line which is located at the top of FIG. 3.

As illustrated in FIG. 4, each numeral of the number line 46 is provided with a dot 48 indicating proper initial placement of a writing instrument (not shown), such as a pencil, for correctly making the numeral. Also, each numeral is provided with one or more arrows 50 indicating the directions of movement required of the writing instrument (not shown) to correctly make the numeral.

Figure 5:
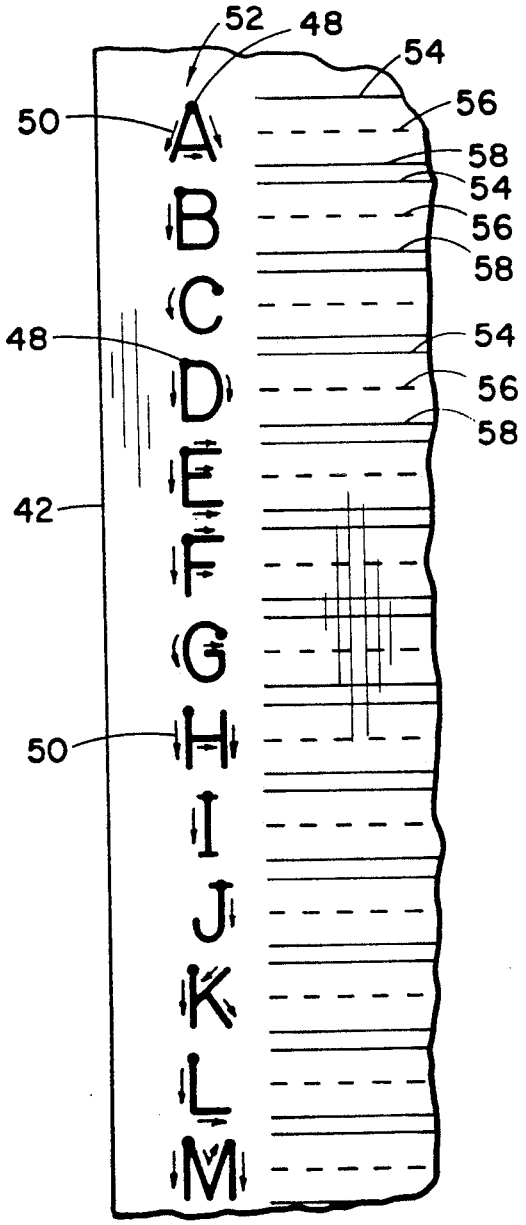
FIGS. 5 and 6 are enlarged partial views of the alphabet which is located at the left side of FIG. 3.
Figure 6:
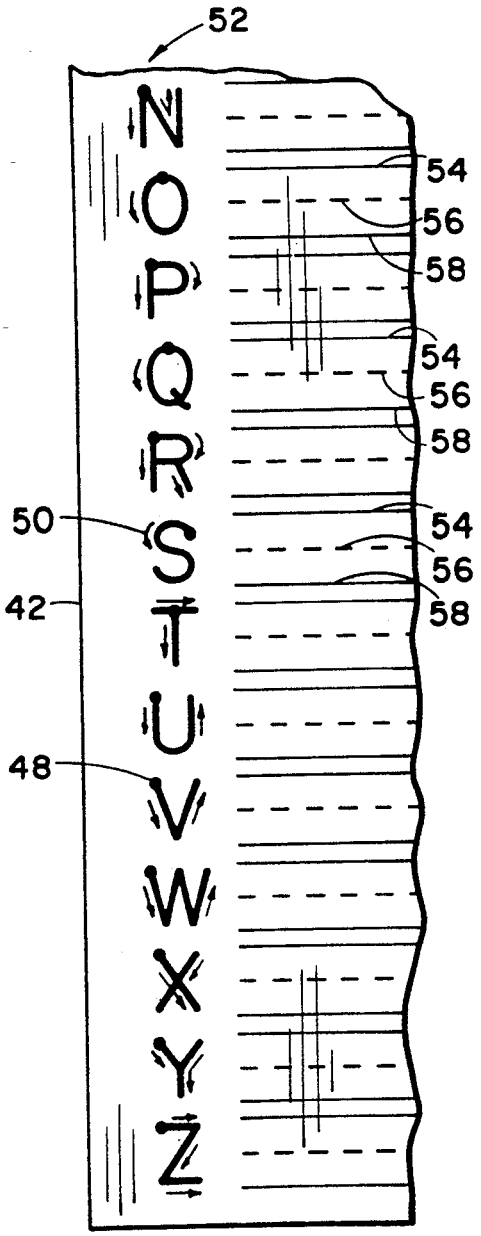

An alphabet 52 is provided along the left upper area side 42, beginning with the letter "A" near the upper edge 40 and listing letters of the alphabet 52 consecutively, ending with the letter "Z" near the bottom side 38 of the upper area 20. As illustrated in FIG. 3, optionally a second alphabet 53 consisting of lower case letters and can be included along side alphabet 52 with alphabet 52 consisting of upper case letters. As illustrated in FIGS. 5 and 6 and similar to the numerals of the number line 46, each of the letters of the alphabet 52 is provided with a dot 48 and one or more arrows 50 indicating respectively proper initial placement and proper movement of the writing instrument (not shown) in order to correctly make each letter.

A set of three evenly spaced apart lines, i.e. a top line 54, a middle line 56 and a bottom line 58, is provided to the right of each letter of the alphabet 52. The lines 54, 56 and 58 run horizontally across the upper area 20 parallel with the upper edge 40. Each of the top lines 54 is solid and each of the bottom lines 58 is solid. However, each of the middle lines 56 is broken so that a student (not shown) learning to write makes his letters or numerals between the top and bottom lines 54 and 58, with the middle lines 56 being provided merely as a reference for the student (not shown) in making letters. Consecutive sets of the three lines, 54, 56 and 58, are spaced slightly apart from each other.

Optionally, the lines 54, 56 and 58 may be of different colors. For example, the top line 54 may be colored green to indicate a starting place, the middle line 56 may be colored yellow to indicate caution, and the bottom line 58 may be colored red to indicate a stopping place.

At least the upper area 20 is preferably made of a white, erasable material, for example, a material used for making marker boards such as LCS ® (white porcelain on steel) or MLC (white melamine writing surface) or other suitable material so the student (not shown) can write directly on the clipboard 10 with a dry erasable liquid marker (not shown).

The upper area 20 is also provided with a clip 6o located along the middle line 47 and below the number line 46. The clip 60 is provided to secure paper (not shown) to the upper area 20 so that the paper (not shown) can be written upon. When the clipboard 10 is secured to the desktop 12 and the paper (not shown) is held by the clip 60 to the clipboard 10, the paper (not shown) is slanted or angled properly for writing with respect to the front edge 13 of the desktop 12. The paper (not shown) is angled with respect to front edge 13 by means of an obtuse angle 62 formed in the clipboard 10. The angle 62 is formed on right-handed clipboards 10 by the left lower area side 22 and the left upper area side 42. Similarly, the angle 62 is formed on left-handed clipboards (not shown) by the right lower area side 24 and the right upper area side 44. The angle 62 is preferably approximately 115 degrees, although the invention is not so limited.

While the invention has been described with a certain degree of particularity, it is manifest that many changes may be made in the details of construction and the arrangement of components without departing from the spirit and scope of this disclosure. It is understood that the invention is not limited to the embodiment set forth herein for the purposes of exemplification, but is to be limited only by the scope of the attached claim or claims, including the full range of equivalency to which each element thereof is entitled.

I claim:

1. A clipboard attachable to a desktop for teaching children how to write correctly comprising:

means to secure said clipboard to said desktop so that said clipboard lies flat against said desktop;

an upper area provided on the clipboard and angled with respect to a front edge of said desktop;

means for securing writing paper to said upper area.

2. A clipboard according to claim 1 wherein at least the upper area is constructed of erasable material.

3. A clipboard according to claim 1 wherein the means to secure said clipboard to said desktop is a lip provided on a lower edge of said clipboard.

4. A clipboard according to claim 3 further comprising a trapezoidal shaped lower area being positioned between said lip and said upper area.

5. A clipboard according to claim 1 further comprising a number line consisting of numerals being provided on an upper edge of the upper area.

6. A clipboard according to claim 5 wherein each numeral of the number line is provided with a dot to indicate the proper initial placement of a writing instrument and with at least one arrow to indicate proper movement of said writing instrument.

7. A clipboard according to claim 1 further comprising at least one alphabet consisting of letters being provided on one side of the upper area.

8. A clipboard according to claim 7 wherein the alphabet is provided on a left side of the upper area.

9. A clipboard according to claim 7 wherein each letter of the alphabet is provided with a dot to indicate proper initial placement of a writing instrument and with at least one arrow to indicate proper movement of said writing instrument.

10. A clipboard according to claim 9 further comprising a set of three horizontal lines being provided beside and associated with each letter of said alphabet.

11. A clipboard according to claim 10 wherein a middle line of each set of three horizontal lines is a broken line.

12. A clipboard according to claim 10 further comprising a top line and a bottom line of each set of three horizontal lines being slightly raised.

13. A clipboard according to claim 1 further comprising repeating sets of three horizontal lines being provided between sides of the upper area.

14. A clipboard according to claim 13 wherein a middle line of each set of three horizontal lines is a broken line.

15. A clipboard according to claim 14 wherein a top line of each set of three horizontal lines is green, the middle line of each set of three horizontal lines is yellow and a bottom line of each set of three horizontal lines is red.

16. A clipboard according to claim 1 wherein a clip attached to the upper area is the means for securing writing paper to said upper area.

17. A clipboard attachable to a desktop for teaching children how to write correctly comprising:

an upper area being provided on said clipboard, said upper area being angled with respect to a front edge of said desktop;

a lip being provided on a lower edge of said clipboard as a means to secure said clipboard to said desktop;

a left side of the upper area being provided with an alphabet consisting of letters;

an upper edge of the upper area being provided with a number line consisting of numerals;

repeating sets of three horizontal lines being provided on said upper area; means for securing writing paper to upper area.

18. A clipboard according to claim 17 wherein an upper line of each set of three horizontal lines is green, a middle line of each set of three horizontal lines is yellow and a bottom line of each set of three horizontal lines is red.

19. A clipboard according to claim 17 further comprising each numeral in said number line and each letter in said alphabet being provided with a dot to indicate proper initial placement of a writing instrument and with at least one arrow to indicate proper movement of said writing instrument.

20. A clipboard according to claim 17 wherein at least the upper area is constructed of erasable material.

* * * * *